United States Patent [19]

Rich

[11] Patent Number: 4,893,436

[45] Date of Patent: Jan. 16, 1990

[54] FELTED FOAM BACK UP PAD

[75] Inventor: Larry D. Rich, Oakdale, Minn.

[73] Assignee: Minnesota Mining and Manufacturing Company, St. Paul, Minn.

[21] Appl. No.: 163,216

[22] Filed: Feb. 25, 1988

Related U.S. Application Data

[63] Continuation of Ser. No. 946,367, Dec. 24, 1986, abandoned.

[51] Int. Cl.[4] ..... B24B 23/00

[52] U.S. Cl. ..... 51/170 MT; 51/170 T; 51/170 PT; 51/358; 51/401

[58] Field of Search ..... 51/354, 358, 170 MT, 51/170 T, 170 PT, 391, 392, 393, 296, 407, 401

[56] References Cited

U.S. PATENT DOCUMENTS

| | | | |
|---|---|---|---|
| 3,025,200 | 3/1962 | Powers | 154/54 |
| 3,924,362 | 12/1975 | McAleer | 51/358 |
| 4,671,019 | 6/1987 | Hutchins | 51/170 MT |

*Primary Examiner*—Frederick R. Schmidt
*Assistant Examiner*—Maurina Rachuba
*Attorney, Agent, or Firm*—Donald M. Sell; Walter N. Kirn; William L. Huebsch

[57] ABSTRACT

A back up pad of felted polyurethane foam for use on a vibrating or oscillating sanding device that both efficiently transfers driving forces between the surfaces of the pad to drive a sheet of coated abrasive adhered to its outer surface against a workpiece, and restricts chattering and bouncing of the sanding device on the workpiece.

6 Claims, 2 Drawing Sheets

FELTED FOAM BACK UP PAD

This is a continuation of application Ser. No. 946,367 filed Dec. 24, 1986, now abandoned.

FIELD OF THE INVENTION

The present invention relates to back up pads used to back and support coated abrasive sheets on power driven sanders of the vibrating or orbital type.

BACKGROUND

Power driven finish sanders of the vibrating or orbital type such as the Model 330 "Speed-Block" TM quarter sheet sander or the Model 505 "Heavy Duty" half sheet sander sold by Porter-Cable Corp., Jackson, Tenn., originally were sold with felt back up pads to back and support coated abrasive sheets driven by the sanders. Typically such pads had rectangular spaced parallel major surfaces, one of which was driven in a small reciprocating or orbital pattern by a drive mechanism in the sander, and the other of which supported the sheet of abrasive coated material. The sheet of coated abrasive material was held along the surface on which it was supported by clamps at the ends of the pad that engaged end portions of the sheet of abrasive coated material that extend around opposite ends of the pad.

I started a project to substitute for Porter-Cable's felt back up pad a back up pad to which abrasive sheets coated with pressure sensitive adhesive (e.g., "Stikit" TM coated abrasive sheets available from Minnesota Mining and Manufacturing Company) could be releasably adhered . It was found that the physical properties of the back up pad had a significant effect on the ability of the sanders to perform effectively. When the back up pad included a layer of a highly resilient or bouncy elastic material such as the neoprene foam rubbers having shore A compression readings of 3 and 1 respectively which are respectively commercially designated R411N and G231-N and are available from Rubatex Corporation, Bedford, Va., or the closed cell neoprene foam or the open cell polyurethane foams having shore A compression readings of 25 and 8 respectively which are respectively commercially designated SN-430 and HD-150 and are available from Illbruck, U.S.A., Minneapolis, Minn., such resilient or bouncy elastic material efficiently transferred driving forces from one surface attached to the drive mechanism of the sander to another surface along which the coated abrasive sheet was adhered in a direction parallel to those surfaces, but had a strong tendency to cause the tool to chatter and bounce on the workpiece being sanded. Such chatter and bouncing resulted in low cutting efficiency, gouging, and irregular scratch patterns on the workpiece. When the back up pad included a layer of a polymeric material that was relatively soft and had low resiliency or bounce such as the closed cell neoprene rubber foam having a shore A compression reading of 1–2 commercially designated R5010A available from Rubatex Corporation or the closed cell neoprene rubber foam, having a shore A compression reading of 6, the closed cell polyvinyl chloride having a shore A compression reading of 1, or the open cell polyurethane/ether having a shore A compression reading of 1 respectively commercially designated as SN-410; SV-210; and E-290, and available from Illbruck, U.S.A., Minneapolis, Minn., the sanding pad would not cause the tool to chatter and bounce on the workpiece, however, the driving force would not be efficiently transferred from the surface attached to the drive mechanism of the sander to the surface on which the coated abrasive sheet was adhered so that little sanding was done by the coated abrasive. The selection of conventional foam material for use as the pad required a compromise that was not particularly satisfactory in achieving either the optimum transfer of driving forces between those surfaces or in minimizing the tendency of the tool to chatter and bounce on the workpiece, which compromise at best produced results that were not much better than results produced by the use of the original felt pad with the abrasive coated paper clamped along its surface as described above.

DISCLOSURE OF THE INVENTION

The present invention provides a backing pad particularly useful on the Porter-Cable Model 330 "Speed-Block" TM and Model 505 "Heavy Duty" finish sanders that both restricts chatter and bouncing of the tool on the workpiece and efficiently transfers driving forces between the surfaces of the pad to drive the coated abrasive sheet against a workpiece.

According to the present invention there is provided a back up pad for use as the drive platen of a vibrating or orbital sander comprising a riged back up plate adapted to be attached to the drive mechanism of the sander, sander, and a layer of felted polyurethane foam believed to be foam formed by compressing one or more layers of foam in a first direction to reduce the thickness of the layers to provide a desired density (e.g., the felted polyurethane foam commercially designated RF-4-900Z available from Scott-foam Corporation, Eddystone, Pa.) having a shore A compression reading measured in said first direction in the range of about 2 to 20, which layer of foam has first and second generally parallel opposite surfaces extending normal to the first direction in which it is compressed with its first surface fixed to the back up plate, and its second surface adapted to have a coated abrasive sheet fixed thereto by having bonded thereon a cloth layer adapted to be releasably engaged by the pressure sensitive adhesive on the coated abrasive sheet.

The process by which the felted polyurethane foam is made apparently substantially increases the ability of such a foam to transfer forces in the plane at right angles to the direction in which it is compressed so that it can provide efficient driving force transmission between first and second surfaces of the pad in a direction parallel to those surfaces, while retaining the effect of relatively low resistance to compression in the direction in which it was compressed so that a sander by which it is driven has little tendency to chatter and bounce on the surface of a workpiece being sanded. It is postulated that some of the cell walls are ruptured during the felting process, thus interlocking 3-dimensionally the cellular structure. This could account for the unexpectedly high sanding efficiencies since almost 100% of the vibrational energy from the tool could be transferred through the bulk of the pad and made available to do work in the plane holding the coated abrasive material. Whatever the reason, the felted polyurethane foam back up pads according to the present invention have been found to both increase the overall sanding performance of vibrating or orbital sanders due to such driving efficiency and lack of chatter and bouncing, and to facilitate easier changing of abrasive sheets on such sanders because of their acceptance of sheets of abrasive material coated with pressure sensitive adhesive.

BRIEF DESCRIPTION OF THE DRAWING

The present invention will be further described with reference to the accompanying drawing wherein like numbers refer to like parts in the several views, and wherein.

DETAILED DESCRIPTION

Figure 1:
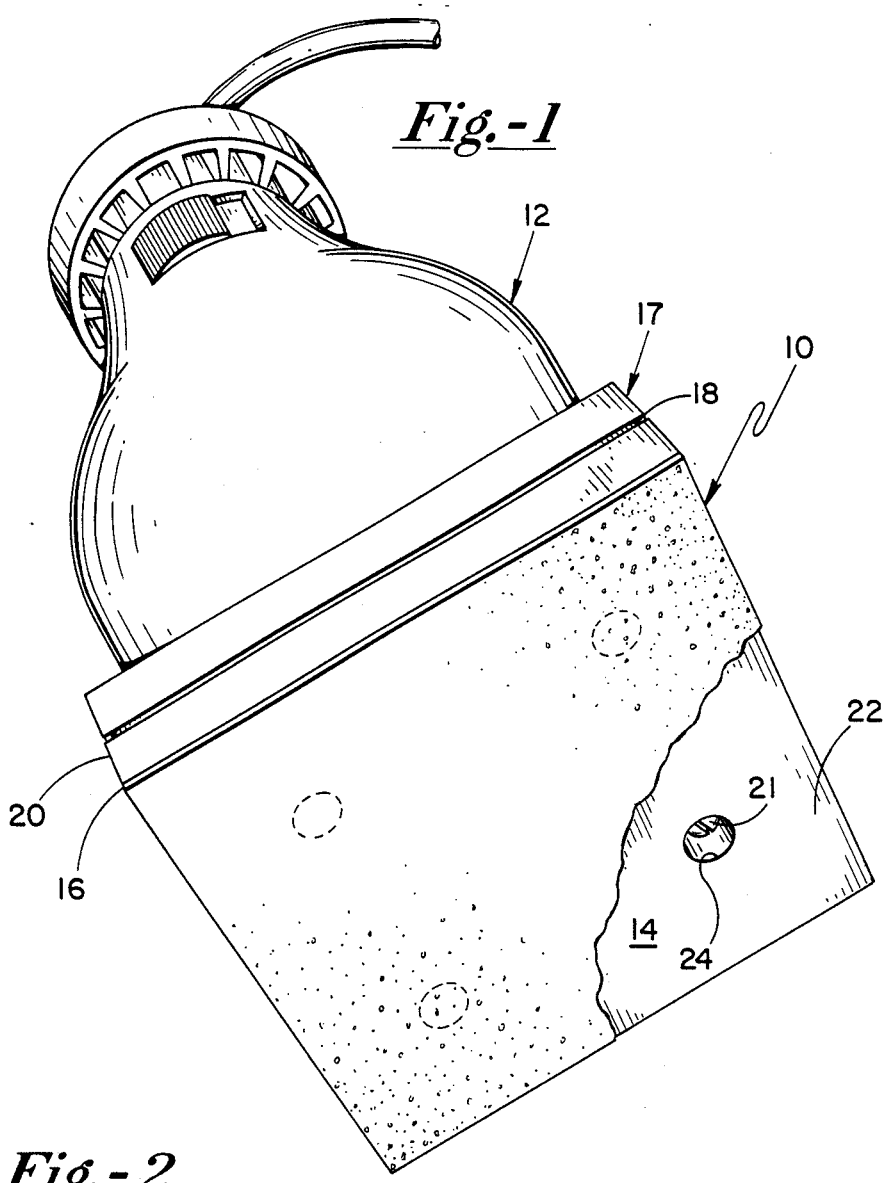
FIG. 1 is a view in perspective, having parts broken away to show detail, of a vibrating sanding device to which is attached a back up pad according to the present invention with a coated abrasive sheet adhered to a surface of the pad.
Figure 2:
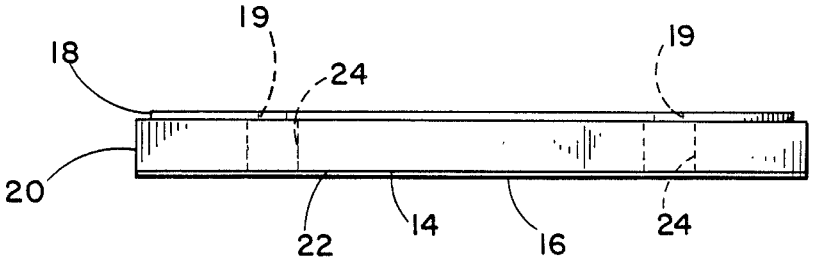
FIG. 2 is an edge view of the pad shown in FIG. 1.
Figure 3:
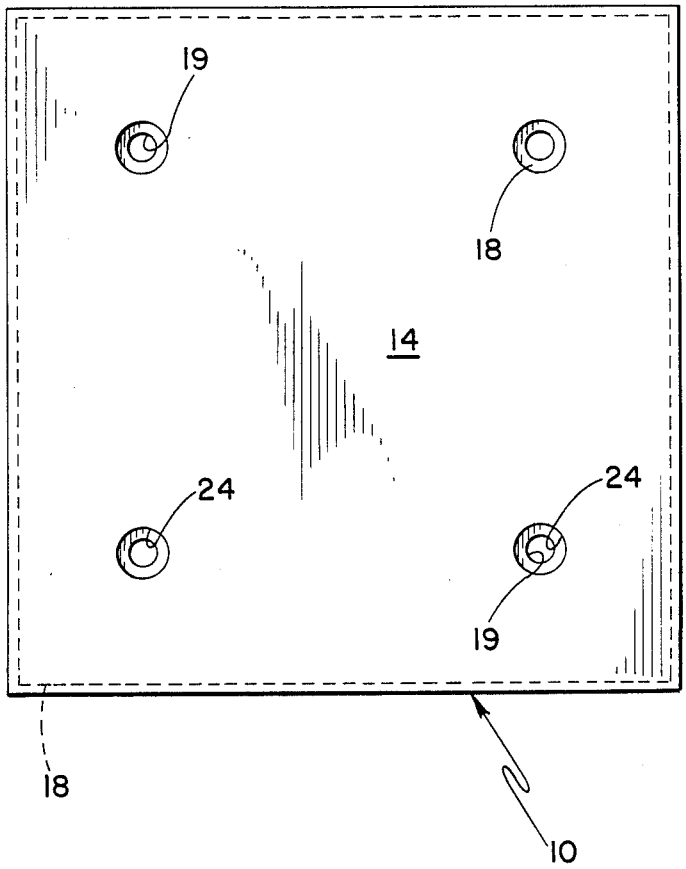
FIG. 3 is an bottom view of the pad shown in FIG. 1 with the coated abrasive sheet removed.

Referring now to the drawing, there is shown in FIG. 1 a back up pad 10 according to the present invention attached to a vibrating finish sander 12 (e.g., the Porter-Cable Model 330 "Speed Block" TM), which back up pad 10 has adhered at its second or outer surface 14 a sheet of coated abrasive material 16 having a layer of pressure sensitive adhesive on its back surface (e.g., a "Stikit" TM brand coated abrasive sheet from Minnesota Mining and Manufacturing Company, St. Paul, Minn.).

The back up pad 10, which is incorporated in a drive platen 17 for the vibrating sander 12, comprises a rigid aluminum back up plate 18 adapted to be attached to a drive mechanism of the sander 12 by four screws 21 that extend through four spaced holes 19 in the back up plate 18, a layer of felted polyurethane foam 20 (e.g., the foam sold by The Scott Foam Corporation, Eddystone, Pa. under the trade designation Scottfelt RF-4-900Z) having first and second generally parallel opposite surfaces with its first surface fixed as by an adhesive to the back up plate 18 and having adhesively bonded on its second surface a fabric layer 22 (e.g., Ponte De Roma, polyester double knit, available from Minnesota Fabrics, St. Paul, Minn.) that provides the outer surface 14 of the back up pad 10 to which the sheet of abrasive material 16 is releasably adhered. The layer of felted polyurethane foam 20 and fabric layer 22 have through clearance holes 24 for the heads of the attaching screws 21. The layer of felted foam has a thickness in the range of about ¼ to ⅜ inch and preferably about 5/16 inch thick between its surfaces, provides efficient driving force transmission in a plane parallel to its surfaces from its first surface to its second surface, and is resilient while having a shore A compression reading in the range of about 2 to 20 measured on its second surface in a direction perpendicular to its second surface so that it has little tendency to bounce on a workpiece being sanded. Also the layer of felted foam has a periphery that projects about 1/16 inch beyond the edges of the back up plate 18 on all sides to restrict contact between the edges of the back up plate 18 and a workpiece.

Felted polyurethane foam available from Scott Foam Corporation under the trade designation "Scottfelt" TM in firmnesses ranging from 3–8 (i.e., the firmness number being a number that will, when multiplied by the number 1.6 and by the number 2.1, give the allowable range of densities in pounds per cubic foot for a felted foam of that firmness number, e.g., firmness No. 4 foam has a density range of from 6.4 to 8.4 pounds per cubic foot) have all been found acceptable for use in the back up pad 10, with those designated RF4-900Z or RF-5-900Z (i.e., firmness No's. 4 and 5, grade 900 and process Z) that have shore A compression readings in the ranges of 2 to 5 and 12 to 13, respectively, being the most acceptable for their combination of efficient transfer of driving forces from the drive mechanism of the sander 12 to the sheet of abrasive material 16 being driven through the back up pad 10 and their tendency to restrict unwanted tool chatter and bounce on the workpiece; those designated RF-3-900Z also being acceptable but having slightly less driving efficiency, and those designated RF-8-900Z that have shore A compression readings in that range of 18 to 20 also being acceptable but having a slightly greater tendency to chatter and bounce on a workpiece when used on the Porter-Cable sanders, but (with the other foams described in this paragraph) producing good results when used on the Makita Finish Sander Model B04510 available from the Makita Electric Works, Ltd., Japan. Using the felted polyurethane foam designated RF-4-900Z by Scott Foam Corporation as the layer of foam 20 in the back up pad 10 on the Porter Cable Model 330 "SpeedBlock" TM Sander mentioned above, users have been able to use that finishing sander to sand between sealer and finish coats with good results that could not be obtained using the same sander, grade of coated abrasive paper and the felt back up pad originally supplied with the sander. Also, users using that sander and layer of foam 20 have reported increased sanding efficiencies of at least about 25 percent.

The present invention has now been described with reference to one embodiment thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

I claim:

1. A back up pad for incorporation into the drive platen of a vibrating or orbital sander comprising a rectangular rigid back up plate having four spaced points of attachment adapted to be attached to a drive mechanism of the sander, and a rectangular layer of felted polyurethane foam having first and second generally parallel opposite surfaces with said first surface fixed to said back up plate, and said second surface adapted to have a coated abrasive sheet removably adhered thereto, said layer of felted polyurethane foam providing efficient driving force transmission between said first and second surfaces of the pad in a direction parallel to said surfaces to drive a coated abrasive sheet removably adhered to said second surface from driving forces applied at said first surface through said back up plate, and said layer of felted polyurethane foam having a Shore A compression reading measured in a direction normal to said surfaces in the range of about 2 to 20 to provide relatively low resistance to compression in a direction normal to said second surface so that a sander by which the back up pad is driven has little tendency to chatter and bounce on the surface of a workpiece being sanded.

2. A back up pad according to claim 1 further including a fabric layer bonded to the second surface of said layer of foam.

3. In combination, a vibrating or orbital sander comprising a drive mechanism including a platen and means for driving the platen in a small reciprocal or orbital pattern, and a back up pad incorporated in said drive platen comprising a rigid back up plate attached to the drive mechanism of the sander, and a layer of felted polyurethane foam having first and second generally parallel opposite surfaces with said first surface fixed to said back up plate, and said second surface adapted to have a coated abrasive sheet removably adhered thereto, said layer of felted polyurethane foam providing efficient driving force transmission between said first and second surfaces of the pad in a direction parallel to said surfaces to drive a coated abrasive sheet removably adhered to said second surface from driving forces applied by said drive mechanism at said first surface through said back up plate, and said layer of felted polyurethane foam having a Shore A compression reading measured in a direction normal to said surfaces in the range of about 2 to 20 to provide relatively low resistance to compression in a direction normal to said second surface so that said sander has little tendency to chatter and bounce on the surface of a workpiece being sanded.

4. A combination according to claim 1 further including a fabric layer bonded to the second surface of said layer of foam.

5. A back up pad for incorporation into the drive platen of a vibrating or orbital sander comprising a rigid back up plate adapted to be attached to a drive mechanism of the sander, and a layer of felted polyurethane foam having first and second generally parallel opposite surfaces with said first surface fixed to said back up plate, and said second surface adapted to have a coated abrasive sheet removably adhered thereto, said layer of felted polyurethane foam providing efficient driving force transmission between said first and second surfaces of the pad in a direction parallel to said surfaces to drive a coated abrasive sheet removably adhered to said second surface from driving forces applied at said first surface through said back up plate, and said layer of felted polyurethane foam having a Shore A compression reading measured in a direction normal to said surfaces in the range of about 2 to 20 to provide relatively low resistance to compression in a direction normal to said second surface so that a sander by which the back up pad is driven has little tendency to chatter and bounce on the surface of a workpiece being sanded.

6. A back up pad according to claim 5 further including a fabric layer bonded to the second surface of said layer of foam.

* * * * *